US011565931B2

(12) United States Patent
Neubauer et al.

(10) Patent No.: US 11,565,931 B2
(45) Date of Patent: Jan. 31, 2023

(54) BEVERAGE DISPENSER

(71) Applicant: KRONES AG, Neutraubling (DE)

(72) Inventors: Michael Neubauer, Grassau (DE); Alexander Hafner, Mitterfels (DE); Benedikt Paulus, Hemau (DE); Linda Feldmeier, Schierling (DE); Christoph Sonnauer, Barbing-Altach (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 17/476,563

(22) Filed: Sep. 16, 2021

(65) Prior Publication Data

US 2022/0089425 A1 Mar. 24, 2022

(30) Foreign Application Priority Data

Sep. 18, 2020 (DE) ..... 10 2020 124 352.9

(51) Int. Cl.
*B67D 1/12* (2006.01)
*B67D 1/08* (2006.01)

(52) U.S. Cl.
CPC ..... *B67D 1/1236* (2013.01); *B67D 1/0888* (2013.01)

(58) Field of Classification Search
CPC .. B67D 1/1236; B67D 1/0888; B67D 1/0804; B67D 2001/009
USPC ..... 141/266, 284; 222/320
See application file for complete search history.

(56) References Cited

U.S. PATENT DOCUMENTS

| | | | | |
|---|---|---|---|---|
| 4,966,205 | A * | 10/1990 | Tanaka | A45D 40/16 141/105 |
| 7,275,570 | B2 * | 10/2007 | McGlinchy | E06B 3/67317 141/62 |
| 8,327,889 | B2 * | 12/2012 | Ashrafzadeh | G07F 13/06 141/192 |
| 9,126,818 | B2 * | 9/2015 | Chase | G07F 13/06 |
| 9,487,384 | B1 * | 11/2016 | Denise | F25D 29/001 |
| 10,526,185 | B2 * | 1/2020 | Jagannathan | B67D 1/0037 |
| 10,858,235 | B2 * | 12/2020 | Jung | B67D 3/0093 |
| 10,889,483 | B2 * | 1/2021 | Jung | B67D 1/0014 |
| 10,941,048 | B2 * | 3/2021 | Moon | B67D 1/0859 |
| 11,084,707 | B2 * | 8/2021 | Wade | B67D 1/0888 |
| 11,117,793 | B1 * | 9/2021 | Khan | B67D 1/0888 |
| 11,186,475 | B2 * | 11/2021 | Kim | B67D 1/0081 |
| 11,273,463 | B2 * | 3/2022 | Kim | B67D 1/0085 |
| 2009/0314801 | A1 | 12/2009 | Ashrafzadeh et al. | |

(Continued)

FOREIGN PATENT DOCUMENTS

| | | | |
|---|---|---|---|
| DE | 10 2007 017 498 | A1 | 10/2008 |
| EP | 2 604 571 | A1 | 6/2013 |

(Continued)

*Primary Examiner* — Timothy L Maust
(74) *Attorney, Agent, or Firm* — Schmeiser, Olsen & Watts, LLP

(57) ABSTRACT

Provided is an apparatus for filling containers with a positioning surface on which a container to be filled can be arranged, with a filling device which is suitable and intended for filling the container via its container opening. According to embodiments of the invention, the apparatus has a contour detection device which is suitable and intended for determining a contour of the container to be filled, as well as a determination device which, taking into account the contour of the container, detects an internal volume of the container.

16 Claims, 1 Drawing Sheet

(56) References Cited

U.S. PATENT DOCUMENTS

| | | | | |
|---|---|---|---|---|
| 2011/0200718 | A1* | 8/2011 | Swertvaegher | B65B 3/326 141/1 |
| 2015/0047742 | A1* | 2/2015 | Baldo | A47J 31/46 141/378 |
| 2018/0201492 | A1 | 7/2018 | Jung et al. | |
| 2019/0062137 | A1* | 2/2019 | Schick | B67D 1/0034 |
| 2019/0377973 | A1 | 12/2019 | Jin et al. | |
| 2021/0078848 | A1 | 3/2021 | Nocchi et al. | |
| 2021/0387845 | A1* | 12/2021 | Taylor | B67D 1/1236 |

FOREIGN PATENT DOCUMENTS

| | | | |
|---|---|---|---|
| WO | 2014091284 | A1 | 6/2014 |
| WO | 2014095985 | A1 | 6/2014 |

* cited by examiner

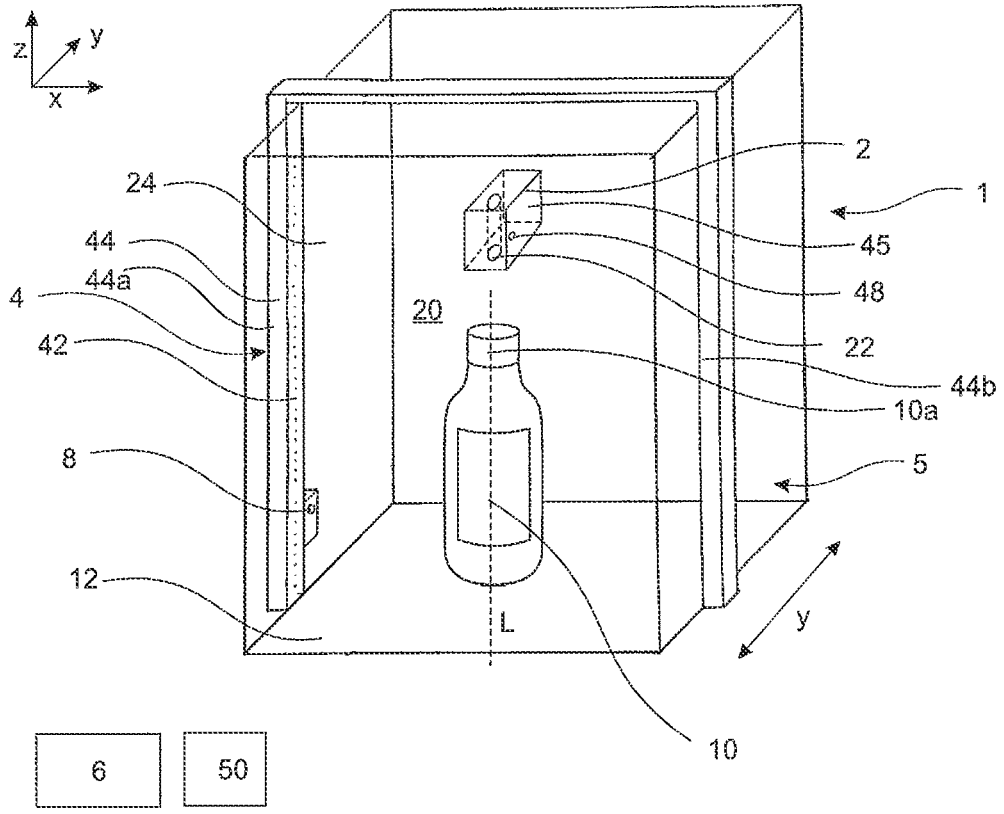
z
y
x
2
1
24
45
44
48
44a
4
20
22
42
44b
10a
8
5
12
L
y
10
6
50

BEVERAGE DISPENSER

CROSS-REFERENCE TO RELATED APPLICATION

This application claims priority to German Application No. 10 2020 124 352.9, having a filing date of Sep. 18, 2020, the entire contents of which are hereby incorporated by reference.

FIELD OF TECHNOLOGY

The following relates to an apparatus in a method for filling containers and in particular to a so-called beverage dispenser. Beverage dispensers are known in the conventional art in a wide variety of configurations. Beverage dispensers are also known in which a user places an empty container in the beverage dispenser and this is subsequently filled.

BACKGROUND

In state-of-the-art beverage dispensers, the user is responsible for selecting the appropriate filling volume. This is done either by selecting the desired volume by pressing a button or in some other way, or by pressing a button for as long as the dispenser is to be filled. Both procedures have a great potential for error. For example, the container can be overfilled or the outside of the container can become dirty.

In addition, some of the filling medium is wasted with these procedures. Furthermore, this procedure is problematic, in particular with beverage dispensers where the user is not given a specific container, but any container is placed in the beverage dispenser by the user. Such procedures have become more common in recent times, also in consideration of environmental protection, since the user can also set a wide variety of reusable containers.

SUMMARY

An aspect relates to avoiding overfilling of containers. In particular, embodiments of the invention are also intended to be applicable to a wide variety of containers.

An apparatus for filling containers according to embodiments of the invention has a positioning device and, in particular, a positioning surface on which a container to be filled can be arranged. Furthermore, the apparatus has a filling device which is suitable and intended for filling the container via its container opening, in particular with a liquid medium.

According to embodiments of the invention, the apparatus comprises a contour detection device which is suitable and intended for determining a contour and, in particular, an outer contour of the container to be filled, as well as a determination device which, taking into account the contour of the container, determines an inner volume of the container.

It is therefore proposed within the scope of embodiments of the invention that a contour and, in particular, an outer contour of the container is detected. In particular, it is possible that the internal volume of the container is determined taking into account also a (possibly approximate) wall thickness of the container wall of the container. In an embodiment, the filling device has a control device for controlling the filling of the container as a function of this detected internal volume.

The filling device can have a measuring device to determine the amount of liquid filled into the container. This can be a flow meter or a load cell, for example. It would also be possible to determine the volume of the filled liquid by measuring the filling time (time filling).

In an embodiment, the liquid to be filled is a beverage.

In an alternative embodiment according to the invention, the apparatus for filling containers has a positioning device and in particular a positioning surface on which a container to be filled can be arranged. Furthermore, the apparatus has a filling device which is suitable and intended for filling the container via its container opening, in particular with a liquid medium. According to embodiments of the invention, the apparatus here generally has a volume determination device which detects an internal volume of the container to be filled and the filling device fills this container taking into account the internal volume to be determined.

For example, it would also be conceivable that a height of the container is detected or determined and an internal volume is estimated, for example, based on a plurality of different containers on this height. It would also be possible that, in addition to the height of the container, its cross-section is also detected, for example the base area of the container is determined and the internal volume of the container is estimated on the basis of the base area and the height.

In an embodiment, the apparatus has a position detection device that detects a position of the container relative to the positioning surface. In this way, as explained in more detail below, a filling element or a filling nozzle can be moved into the correct position for the filling process.

In an embodiment, the positioning surface is horizontal and the container is placed on this surface in an upright position (with the opening and, in particular, a mouth facing upwards). However, it would also be possible to place the container in the filling device or beverage dispenser at an angle. In an embodiment, the container is a bottle. However, other containers such as cups, canisters, cans or the like can also be used.

In an embodiment, the device has a user interface with which the user can select at least one variable characteristic of the filling process. For example, the user can select a beverage to be filled, or a volume to be filled, by this user interface. The user can also, if necessary, determine the temperature of the liquid to be filled, for example whether to obtain hot or cold water. In another embodiment, the apparatus also has a display device that outputs information to the user, such as a selection of beverages available or the like.

In another embodiment, the apparatus comprises a reservoir or container for holding a liquid and in particular a beverage.

In a further embodiment, the filling device comprises a filling element which is movable at least in a direction which is perpendicular to the longitudinal direction of the container (and/or which is parallel to a plane of the positioning surface). In this way, the filling element can be adapted to the position of the container. In an embodiment, the filling element is a filling nozzle that can be positioned above the mouth for filling.

In an embodiment, this filling element is also movable in a second direction which is perpendicular to the longitudinal direction and perpendicular to the first direction. This means that the filling element is movable within a plane that is perpendicular to the longitudinal direction of the container.

In a further embodiment, the filling element can be moved in the longitudinal direction of the container to be filled. In this way, containers of different heights can also be filled, for which purpose the filling element is brought close to the mouth or the opening of the container. In this way, the apparatus or the outside of the container to be filled can be prevented from becoming soiled with filling material.

In an embodiment, the contour detection device is suitable and intended to generate a two-dimensional image of the container. In this embodiment, it is assumed that the container itself is rotationally symmetrical as usual. From this two-dimensional image of the container, the internal volume can also be inferred or determined, taking into account the rotational symmetry.

In an embodiment, it is possible that this contour or an image of this contour is reproduced on an image reproduction device.

In an embodiment, the contour detection device has a plurality of radiation sources whose radiation can be directed onto the container. These radiation sources can in particular be light sources, for example LEDs or laser light sources. In an embodiment, these radiation sources are arranged one above the other in a height direction or on the longitudinal direction of the container. In an embodiment, these radiation devices are arranged equidistantly to each other. For example, it is possible that the individual radiation devices are arranged at a predetermined distance from one another. In an embodiment, these radiation sources are arranged along a line.

In this embodiment, the beverage dispenser thus has a sensor system to determine the contour and/or the volume of the container to be filled. In the embodiment described here, for example, a light curtain can be used to measure the contour of the container.

In an embodiment, the light sources have a distance to each other which is greater than 0.1 mm, greater than 0.3 mm, greater than 0.5 mm, greater than 1 mm and/or greater than 2 mm. In a further embodiment, the light sources have a distance from each other that is less than 20 mm, less than 15 mm, less than 10 mm, less than 8 mm and/or less than 7 mm.

In an embodiment, the contour detection device also has sensor devices that detect light. In this way, it is possible for the contour detection to be designed in the manner of a plurality of light barriers, each of which is suitable for detecting the contours of the container by resolving in the longitudinal or vertical direction of the container in each case whether or not the container is present in this area. In an embodiment, however, these sensor devices are arranged on the same side of the device with respect to the container and thus detect reflections of the radiation emitted by the radiation sources which have been reflected by the container.

Instead, however, one or more laser units could be provided that are designed to be movable in order to scan the interior of the apparatus for the container.

In an embodiment, the mentioned radiation or light sources are arranged on a carrier that can be moved in a direction perpendicular to the longitudinal direction of the container. In this way, the space in which the container is located can be scanned in a transverse direction of the container and thus the contour of the container can also be detected.

However, it would also be possible for an array of light sources to be provided that extends both in the longitudinal direction of the container and in a direction transverse to this. In this case, the individual light sources of this array can be activated in rows, for example, in order to scan for the presence of the container in this way.

In an embodiment, this light curtain or the radiation sources are arranged parallel to a side surface of a receiving space, wherein this receiving space serves to receive the container. In an embodiment, a side surface which absorbs light is arranged on the side of the space opposite these radiation sources. In this way, the container can be detected with spatial resolution using this plurality of radiation sources.

It is possible that these radiation sources or light sources can be activated individually or in groups in order to scan the container. It would be possible for the carrier with the radiation sources to be moved step by step and in each position either all radiation sources are activated together or in a predetermined sequence in order to determine the contour of the container.

Instead of the plurality of radiation sources, however, it would also be possible to use one or more cameras which observe the recording space with the container standing in it. With a corresponding image evaluation device, it is also possible to measure the contour of the container standing in the receiving space or on the surface.

For example, it would be possible that two image recording devices, or two cameras, are provided which observe the container. It would be possible that the container is observed with two image recording devices from two different sides, for example by two cameras in two different transverse directions of the container. In addition, it would also be possible that an image recording device, or camera, is arranged above the container. It would also be possible for the position of the container as well as its contour to be recorded by suitable image recording software.

For the evaluation of the respective images, it is possible that artificial intelligence is used, such as deep learning methods. It is also possible to compare the images taken by the cameras with a plurality of reference images in order to deduce the type of container. However, it would also be possible for the image evaluation device or the image recording device to detect the contours of the container, for example because they contrast with a background. For this purpose, an illumination device that illuminates the containers can also be used in addition to an image recording device.

Such an image recording device can also be used to record the fill level of the container by a camera.

From the above-mentioned 2D images, for example, the volume of the container can be determined for round bottles (in particular after subtracting the wall thickness). In this case, it is possible that a certain value, which is permanently programmed in the control, is subtracted as the wall thickness. This eliminates the risk of overfilling the container. In addition, it is not necessary to position the container at a specific point on the positioning surface.

In a further embodiment, the apparatus comprises at least a first distance detection device which is suitable and intended to detect a distance of the container from the distance detection device.

This distance detection device can, for example, be an ultrasonic sensor that detects a distance of the container or its outer wall from this sensor. In an embodiment, this distance detection device is also arranged on the above-mentioned movable carrier and/or can be moved perpendicular to the longitudinal direction of the container. By moving this distance detection device and thus repeatedly detecting the distance, characteristic properties of the container can also be detected, such as whether they are round or angular, since the distance of the container from the distance detection device can be determined as a function of the direction of movement in which the distance detection device moves.

In an embodiment, this distance detection device is arranged in a bottom area of the container. In a further embodiment, it would also be possible for several such distance detection devices to be provided, each of which detects the distance of the container. These could be arranged next to each other in a longitudinal direction of the container as well as in a direction perpendicular to it.

Furthermore, it would also be possible that the user is given the exact position on which he can position the container by suitable measures such as holders. For example, a V-shaped frame could be arranged on the positioning surface in which the user places the container so that it is in a precisely defined position. This frame could, for example, have contact elements so that a filling process is only triggered when the container touches these contact elements. In this way, too, a relatively precise pre-positioning of the container on the positioning surface could be achieved.

In an embodiment, however, the position of the container and in particular also the position of the mouth is determined by the recorded 2D image and the additional ultrasonic sensor (which determines the y-coordinate of the container position) in three-dimensional space. Alternatively, however, a laser scanner, a camera or similar can be used for the purpose of measuring the container.

In this case, the user only needs to place the container to be filled into the device and press a trigger device such as a start button. Alternatively, pressing a button could also be omitted if the existing sensor system is used to detect the placing of the container. Then the filling process (=measuring the container and then filling it) can take place directly after the container has been placed in the machine.

In another embodiment, the apparatus comprises a level detection device which detects a level of a liquid within the container.

This level detection device can be, for example, a further ultrasonic sensor device, which detects the distance to the liquid in the container through an opening of the container. This level detection device can be arranged above an opening of the container to be filled.

Furthermore, this filling level detection device can be arranged on a carrier which is movable in at least one direction perpendicular to the longitudinal direction of the container and in a plane perpendicular to the longitudinal direction of the container. Furthermore, the filling level detection device can be arranged on the same carrier on which a filling element for filling the container is also arranged.

In a further embodiment, the filling level detection device is an optically operating filling level detection device. It would be possible, for example, for an image recording device to observe the container through the mouth or from the side and to conclude the level of the liquid in the container from a correspondingly recorded image.

A laser that shines into the side of the container can also be used as a filling level detection device. In addition, the filling level detection device could also have other sensor devices, such as an acoustic camera or a radar probe, which inspect the container from above through the mouth or from the side and conclude the filling level accordingly.

In a further embodiment, the device has an input device via which a user can control the apparatus, for example trigger a filling process. Thus, an input field can be provided via which the user can enter commands or selections to the apparatus.

However, it would also be conceivable for the apparatus to have an input module with voice control. Here, for example, the user can start a filling process, select a drink or the like by voice input.

Embodiments of the invention are further directed to a method for filling containers, wherein a container arranged on a positioning surface is filled by a filling device via its container opening. According to embodiments of the invention, a contour of the container is detected by a contour detection device and an internal volume of the container is determined taking this contour into account.

In an embodiment, the wall thickness of the container is also taken into account when determining the internal volume of the container. In an embodiment, a position of the container on the positioning surface is also detected, which, as described above, can be done in particular by distance detection devices.

In a further method, a filling process of the container is also controlled based on this internal volume.

In a further method, a filling level of a liquid in the container is determined at least once and the filling process is determined on the basis of this filling level. In a method, the wall thickness of the container is inferred and/or determined from the filling level and in particular taking into account the contour of the container.

Several procedures are conceivable for starting a filling process. For example, a filling process could be started by an input of the user, e.g., by pressing a button. The filling process can also start automatically after a container has been set. For example, the filling process can be started automatically after the contour and/or position of the container has been measured. This means that the triggering is initiated, for example, by the light curtain or the contour detection device described above.

However, it would be conceivable to trigger the filling process by reading or detecting markings, for example by reading RFID chips, QR codes, bar codes or the like and in particular markings that are located on the container. For example, the container could be identified on the basis of such a marking and a corresponding filling process could be triggered.

In an embodiment, the apparatus has a safety device that only allows the container to be filled when certain conditions are met. For example, a sensor device can detect whether a user's hand is still in the filling space. Only when this is no longer the case the filling process is triggered and/or started.

In a method, first a portion of the liquid to be filled is filled into the container and then its fill level is determined and from this in turn the wall thickness of the container is inferred.

In a further method, it would also be possible for a bottom contour of the container to be detected and/or measured. This can also be achieved, for example, by the ultrasonic distance measuring device mentioned above.

The methods described above work with all containers that have approximately the same wall thickness. However, problems can arise if, for example, glass bottles or double-walled stainless steel or aluminium cups are filled on the machine instead of PET containers. In this case, the wall thickness can vary greatly, so that a different method is proposed for this case.

In this method, the outer contour of the container is also determined as described above. Then a filling process begins. However, only a part of the liquid, for example 50% of the calculated filling volume, is filled and then briefly interrupted. During this interruption, a further measurement is carried out. A sensor device, for example an ultrasonic sensor, measures the filling level reached, from above and/or through the mouth of the container. The wall thickness of the container can be calculated from the comparison of a target filling level and the actual filling level.

Then a residual quantity to be filled is calculated and the filling process is continued. This method can be used to fill all types of containers, including, for example, double-walled or rectangular containers. In any case, the ideal desired volume can be filled.

BRIEF DESCRIPTION

Some of the embodiments will be described in detail, with reference to the following FIGURES, wherein like designations denote like members, wherein:

FIG. 1 shows a filling device according to embodiments of the invention or a beverage dispenser.

DETAILED DESCRIPTION

FIG. 1 shows a schematic representation of an apparatus 1 or beverage dispenser 1 according to embodiments of the invention. This has a housing 5 which surrounds an interior 20. This housing has several side walls, such as the side wall 24.

The reference sign 12 indicates a positioning surface which is flat and horizontal and on which a user can position an unsealed container 10 with its mouth 10*a* facing upwards. The reference sign L indicates the longitudinal direction of the container.

The reference sign 2 roughly schematically indicates a filling device for filling the container. This filling device has a filling element 22 which can fill a liquid into the container 10. This filling element 22 is arranged on a carrier 45. This carrier 45 can be moved in the directions x and y. In addition, this carrier is also movable in the direction z, which is parallel to the longitudinal direction of the container 10. In this way, the filling element can be positioned over the opening 10*a* in order to fill the container 10.

Reference 48 indicates a second sensor device used to detect a filling level within the container. Furthermore, the second sensor device 48 can be used to check whether the user has removed the closure of the container before placing it in the device before starting the filling process. The device further comprises drives (not shown) which enable movement of the carrier 45 in the directions x, y, z. These drives are in particular electric motor drives, but pneumatic, hydraulic or linear motor drives would also be conceivable. The reference sign 50 schematically indicates a control device for controlling a movement of the carrier or the filling element and/or the sensor device 48. The reference sign 6 indicates a processor device.

The reference sign 44 indicates a carrier which is movable in the direction y and on which a plurality of radiation sources 42 are arranged. By moving the carrier 44, the interior 20 can be scanned and by irradiating the container 10, its contour can be recorded. In addition, sensor devices (not shown) can be provided on the carrier for detecting the radiation emitted by the radiation sources 42 and reflected by the container 10.

However, it would also be possible for the radiation devices 42 to be located on a first portion 44*a* of the carrier 44 and sensor devices to be located on the opposite portion 44*b* of the carrier. In this case, contour detection is achieved by the use of a plurality of light barriers, each formed by the radiation devices on the section 44*a* of the carrier and cooperating sensor devices on the section 44*b* of the carrier. By moving the carrier 44 and activating the individual radiation sources accordingly, the outer contour of the container 10 can be measured.

A drive device can also be provided for moving the carrier 44. It would also be conceivable that the carrier 45 is also arranged on the carrier 44 and is arranged movably in the direction x on the carrier 44. In this way, a drive for the device could be saved.

The reference sign 8 indicates a distance measuring device which determines the distance of the container 10 from this distance measuring device. This is also arranged on the carrier 44 and thus movable in the direction v.

The reference sign 6 schematically indicates a determination device or processor device which determines the internal volume of the container on the basis of the determined contour of the container. The filling of the container can be controlled on the basis of the inner volume determined in this way. In addition, the determination device 6 can also determine the position of the container 10 and also its geometric shape on the basis of the data of the distance measuring device 8. Based on this information, the filling element can be moved to the correct filling position.

The applicant reserves the right to claim all features disclosed in the application documents as essential to embodiments of the invention, provided they are individually or in combination new compared to the conventional art. It is further pointed out that the individual FIGURES also describe features which may be advantageous in themselves. The skilled person immediately recognises that a certain feature described in a FIGURE can also be advantageous without adopting further features from this FIGURE. Furthermore, the skilled person recognises that advantages can also result from a combination of several features shown in individual FIGURES or in different FIGURES.

LIST OF REFERENCE SIGNS

1 apparatus
2 filling device
4 contour detection device
5 housing
8 distance measuring device
10 container
10*a* container opening
12 positioning surface
20 inner space
22 filling element
24 side wall
42 radiation device
44 carrier
44*a,b* sections of carrier 42
45 carrier
48 filling level measuring device
L longitudinal direction

The invention claimed is:

1. An apparatus for filling containers, the apparatus comprising a positioning surface on which a container to be filled can be arranged, a filling device which is suitable and intended to fill the container via an opening of the container, a contour detection device comprising one or more sensors, which is suitable and intended for determining a contour of the container to be filled, and a processor configured to detect an internal volume of the container based on the contour of the container, wherein the filling device includes a filling element which is moveable in at least one direction which is perpendicular to a longitudinal direction of the container, wherein the filling element is a filling nozzle that can be positioned above the container opening for filling, wherein the filling element is also movable in a second direction which is perpendicular to the longitudinal direction and perpendicular to the at least one direction, and wherein the filling element can be moved in the longitudinal direction of the container to be filled.

2. The apparatus according to claim 1, including a position detection device having one or more position sensors which detects a position of the container relative to the positioning surface.

3. The apparatus according to claim 1, wherein the contour detection device is suitable and intended to produce a two-dimensional image of the container.

4. The apparatus according to claim 1, wherein the contour detection device comprises a plurality of radiation sources whose radiation can be directed onto the container.

5. The apparatus according to claim 4, wherein the radiation sources are arranged on a carrier which is movable in a direction perpendicular to the longitudinal direction of the containers.

6. The apparatus according to claim 1, wherein the apparatus comprises at least a first distance detecting device having one or more distance sensors, which is suitable and intended to detect a distance of the container from the at least a first distance detecting device.

7. The apparatus according to claim 1, wherein the apparatus has a filling level detection device having one or more level sensors, which detects a filling level of a liquid inside the container.

8. The apparatus according to claim 1, including a safety device having a sensor, wherein the safety device is configured to only allow the container to be filled when certain conditions are met.

9. The apparatus according to claim 1, wherein the filling device includes a measuring device having one or more measuring sensors to determine an amount of liquid filled into the container.

10. The apparatus according to claim 4 wherein a side surface which absorbs light is arranged on the side of the space opposite these radiation sources.

11. The apparatus according to claim 5, wherein a side surface which absorbs light is arranged on the side of the space opposite the radiation sources.

12. A method for filling containers, wherein a container arranged on a positioning surface is filled by a filling device via a container opening of the container, wherein a contour of the container is detected by a contour detection device comprising one or more sensors, and a processor detects an internal volume of the container based on the contour of the container, wherein the filling device includes a filling element which is moveable in at least one direction which is perpendicular to a longitudinal direction of the container, wherein the filling element is a filling nozzle that is positioned above the container opening for filling, wherein the filling element is also movable in a second direction which is perpendicular to the longitudinal direction and perpendicular to the at least one direction, and wherein the filling element can be moved in the longitudinal direction of the container to be filled.

13. The method according to claim 12, wherein a filling level of a liquid located in the container is determined at least once during a filling process and the filling process is controlled on the basis of this filling level.

14. The method according to claim 12, wherein a wall thickness of the container is inferred and/or determined from the filling level and in particular taking into account the contour of the container.

15. The method according to claim 12, wherein a first a portion of a liquid to be filled into the container is filled into the container and then a fill level of the container is determined and then a wall thickness of the container is inferred.

16. The method according to claim 12, wherein a bottom contour of the container is detected and/or measured.

* * * * *